US008628357B2

(12) United States Patent
Tai et al.

(10) Patent No.: US 8,628,357 B2
(45) Date of Patent: Jan. 14, 2014

(54) ELECTRICAL CONNECTOR

(75) Inventors: Hung-Chi Tai, Jhonghe (TW); Yong-Gang Zhang, Taicang (CN); Fei-Bo Ge, Taicang (CN)

(73) Assignee: All Top Electronics (Suzhou) Co., Ltd., Taicang (CN)

( * ) Notice: Subject to any disclaimer, the term of this patent is extended or adjusted under 35 U.S.C. 154(b) by 21 days.

(21) Appl. No.: 13/527,189

(22) Filed: Jun. 19, 2012

(65) Prior Publication Data

US 2013/0267125 A1 Oct. 10, 2013

(30) Foreign Application Priority Data

Apr. 10, 2012 (CN) ..... 2012 1 0102924

(51) Int. Cl.
*H01R 24/00* (2011.01)

(52) U.S. Cl.
USPC ..... 439/660

(58) Field of Classification Search
USPC ..... 439/660, 626, 79, 83, 607.01
See application file for complete search history.

(56) References Cited

U.S. PATENT DOCUMENTS

| | | | | |
|---|---|---|---|---|
| 6,863,549 | B2 * | 3/2005 | Brunker et al. | 439/108 |
| 7,722,407 | B2 * | 5/2010 | Momose | 439/638 |
| 7,744,426 | B2 * | 6/2010 | Zheng et al. | 439/660 |
| 8,079,854 | B2 * | 12/2011 | He et al. | 439/108 |
| 8,267,703 | B2 * | 9/2012 | Yao et al. | 439/79 |
| 8,480,435 | B2 * | 7/2013 | Hsiao et al. | 439/660 |
| 8,485,851 | B2 * | 7/2013 | Kondo et al. | 439/660 |
| 2010/0261385 | A1 * | 10/2010 | Zheng et al. | 439/607.01 |
| 2011/0244728 | A1 * | 10/2011 | Chang et al. | 439/628 |
| 2012/0270443 | A1 * | 10/2012 | Shih | 439/607.01 |
| 2013/0109233 | A1 * | 5/2013 | Chung et al. | 439/607.31 |
| 2013/0178106 | A1 * | 7/2013 | Hsueh | 439/626 |
| 2013/0183868 | A1 * | 7/2013 | Hsueh | 439/676 |

* cited by examiner

*Primary Examiner* — Neil Abrams
*Assistant Examiner* — Phuongchi T Nguyen
(74) *Attorney, Agent, or Firm* — Sughrue Mion, PLLC

(57) ABSTRACT

An electrical connector includes an insulative housing and a number of conductive terminals held in the housing. The insulative housing has a base portion and a tongue portion extending forwardly from the base portion. Each of the conductive terminals includes a contacting portion, and a soldering portion extending outside of the housing. The terminals comprise grounding terminals and differential signal pairs. The soldering portions of each of differential signal pairs is located between two adjacent soldering portions of the grounding terminals.

12 Claims, 3 Drawing Sheets

ELECTRICAL CONNECTOR

BACKGROUND OF THE INVENTION

1. Field of the Invention

The present invention relates to electrical connectors, more particularly to electrical connectors mounting on an printed circuit board (PCB) and transmitting high frequency signals.

2. Description of Related Art

At present, Universal Serial Bus (USB) 3.0 is a serial bus standard to the PC architecture with a focus on computer telephony interface, consumer and productivity applications, with a theoretical maximum transmission speed of 5 Gbps and backward compatibility to USB 2.0. The terminals of the USB 3.0 connector generate crosstalk and interfere with each other when transmitting high frequency signals, which will influence the signal transmission property.

In addition, cross-talk is a concern in designing a high performance connector. Therefore, an improved electrical connector having lower cross-talk is highly desired.

BRIEF SUMMARY OF THE INVENTION

An object of the present invention is to provide an electrical connector with improved terminal arrays to suppress the cross-talk between them.

In order to achieve the object set forth, an electrical connector comprises an insulative housing and a plurality of conductive terminals held in the housing. The insulative housing comprises a base portion and a tongue portion extending forwardly from the base portion. The conductive terminals are held in the tongue portion. Each of the conductive terminals comprises a contacting portion exposed to air and contacting with a portion of another connector mating with the connector, a soldering portion extending outside of the housing and a connecting portion connecting with the contacting portion and the soldering portion. The plurality of terminals comprises a plurality of grounding terminals and a plurality of differential signal pair terminals. The soldering portions of differential signal pairs are located between the adjacent of two soldering portions of the grounding terminals.

With the improved terminals arrangement, the cross-talk between the adjacent two differential signal pair terminals are suppressed and a better signal transmission property can be acquired.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
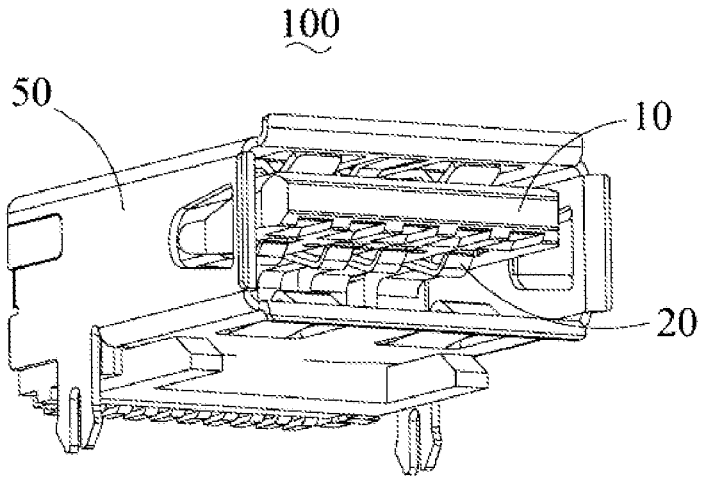
FIG. 1 is a perspective view of an electrical connector according to the present invention.

Reference will be made to the drawing figures to describe the present invention in detail, wherein depicted elements are not necessarily shown to scale and wherein like or similar elements are designated by same or similar reference numeral through the several view.

Referring to FIG. 1, an electrical connector 100 according to the present invention is disclosed. The electrical connector 100 which can be mounted on a printed circuit board (PCB), includes an insulative housing 10, a plurality of conductive terminals 20 held in the insulative housing 10, two holding portions 30 to hold some of the conductive terminals 20, a fixing element 40 (shown in FIG. 4) to locate the conductive terminals 20 at their proper positions, and a metal shell 50 to shield the insulative housing 10. Detail description of these elements and their relationship and other elements formed thereon will be discussed below.

Figure 2:
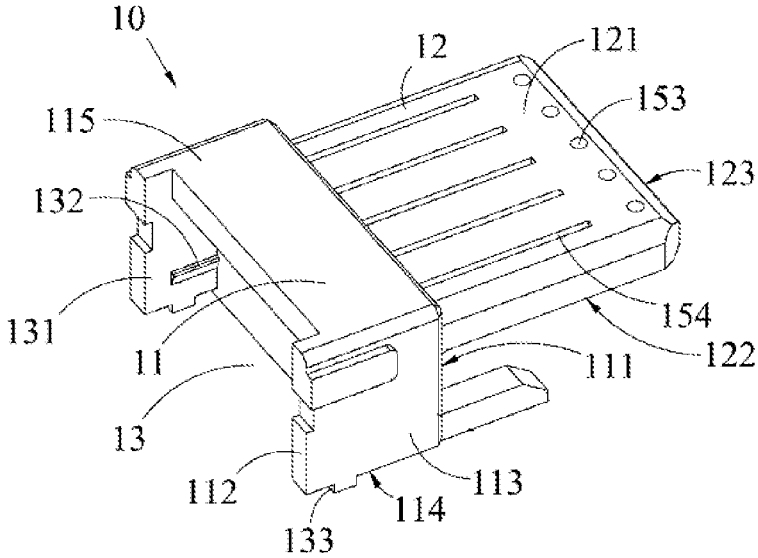
FIG. 2 is a perspective view of an insulative housing of the electrical connector shown in FIG. 1.
Figure 3:
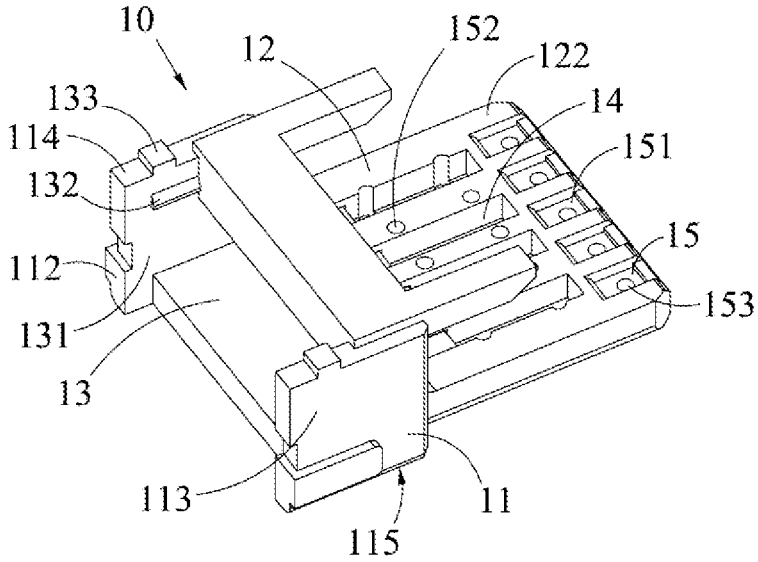
FIG. 3 another perspective view of the insulative housing of the electrical connector shown in FIG. 1, while taken from another aspect.

Referring to FIG. 2 and FIG. 3, the insulative housing 10 includes a base portion 11 and a tongue portion 12 extending forwardly from the base portion 11. The base portion 11 and the tongue portion 12 are integrally injecting molded as a unit one piece, named as the insulative housing 10. The base portion 11 has a substantial cuboid-shape, and defines a front face 111, a rear face 112 opposite to the front face 111, a pair of opposite side faces 113 between the front face 111 and the rear face 112, a bottom face 114 and a top face 115 opposite to the bottom face 114. At the rear end of the base portion 11, a receiving space 13 is defined therein. The receiving space 13 defines two opposite inner side faces 131 and a locking portion 132 protruding from the inner side faces 131 into the receiving space 13. On the bottom face 114, a pair of first retaining portion 133 protrudes outwardly therefrom and is located near the side faces 113. On the side faces 113, a pair of second retaining portions 134 protrudes outwardly and locates near the top face 115. On the rear face 112, a pair of depressions 135 is defined. The depressions 135 extend through the side faces 113 and corresponding inner side faces 131. Besides, near the bottom face 114, a pair of mounting arms 136 extends from the front face 111.

The tongue portion 12 defines a top surface 121, a bottom surface 122 opposite to the top surface 121, and a front surface located between the top surface 121 and a bottom surface 122. On the bottom surface 122 of the tongue portion 12, four first terminal receiving passageways 14 are depressed inwardly along a lengthwise direction. These terminal receiving passageways 14 extend through the front surface 111 of the base portion 11 and communicate with the receiving space 13. The tongue portion 12 also has five second terminal receiving passageways 15. The second terminal receiving passageways 15 include inner passageways (not shown) without any portion exposed directly to outside, and outer passageways 151 communicating with the inner passageways. The outer passageways 151 are depressed inwardly form the bottom surface 122 and are close to the front surface 123. The first and second terminal receiving passageways 14, 15 are staggeredly arranged with each other and are located in two rows along a height direction of the connector.

Still referring to FIG. 2 and FIG. 3, the tongue portion 12 further defines five rows of first through holes 152 depressed inwardly form the bottom surface 122 in the height direction. On the top surface 121, five rows of slots 154 are depressed inwardly form the top surface 121 and extending lengthwise. The first through holes 152 and the slots 154 both communicate with the inner passageways of the second terminal passageways 15. Furthermore, a plurality of second through holes 153 is defined extending through the top surface 121 and communicating with the outer passageways 151 of the second terminal passageways 15. The arrangement of the first/second through holes 152/153 and the slots 154 can enhance the thermal convection between the second terminal passageways 15 and the outer space.

Figure 4:
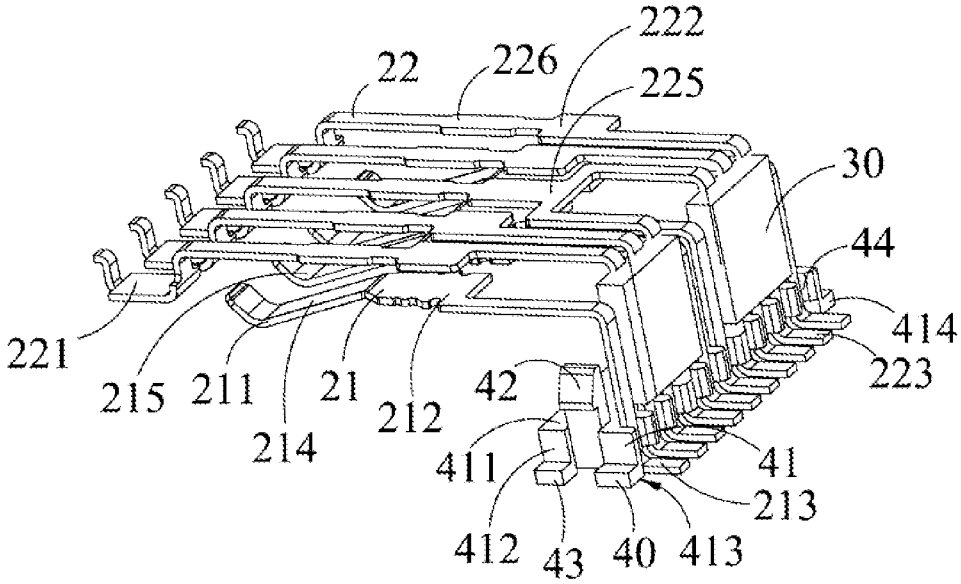
FIG. 4 is a perspective assembly view of a plurality of conductive terminals, a pair of holding portions and a pair of position portions of the electrical connector shown in FIG. 1.
Figure 5:
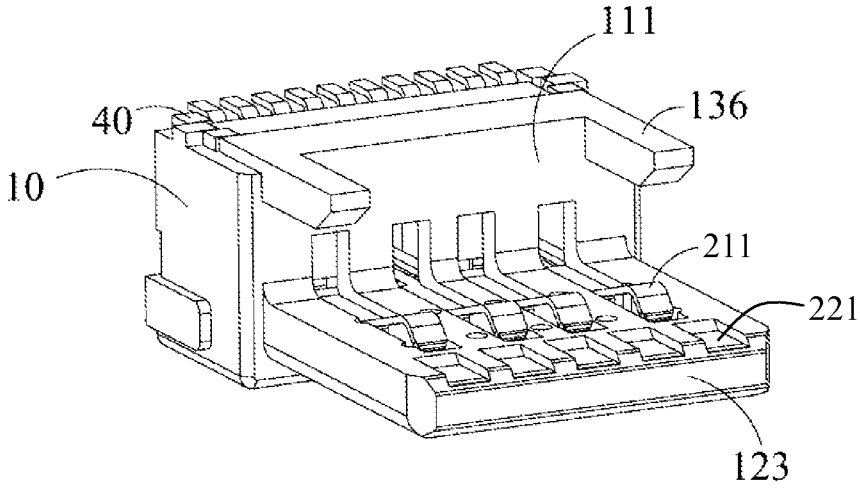
FIG. 5 is a perspective view of the electrical connector with its metal shell removed therefrom, showing the assembly of insulative housing, the conductive terminals, the pair of holding portions and the pair of position portions.

Referring to FIG. 4 and FIG. 5, the conductive terminals 20 include four first conductive terminals 21 received in the first terminal receiving passageways 14 and five second conductive terminals 22 received in the second terminal receiving passageways 15. Each of the first conductive terminals 21 has a contacting portion 211 exposed to the air and electrically contacting with another connector mating with the electrical connector 100, a soldering portion 213 extending beyond the insulative housing 10 and a connecting portion 212 connecting the contacting portion 121 and the soldering portion 213. The contacting portions 211 extend beyond the bottom surface of 122 of the tongue portion 12 and has elasticity. From aspect of the role that the four first terminals 21 play, the four first terminals 21 include power ($V_{BUS}$) terminal 214, ground terminal 214, and a differential signal pairs 215. In application, the four conductive terminals 21 are used to transfer power, D+, D− and ground signals, respectively. The two central first conductive terminals (differential signal pairs) 215 between the power and ground terminals are used to transfer/receive data to/from the peripheral device or a host device (not shown).

Each of the second conductive terminals 22 includes a flat contacting portion 221 exposed to the air and electrically contacting with another connector mating with the electrical connector 100, a soldering portion 223 extending beyond the insulative housing 10 and a connecting portion 222 connecting the contacting portion 121 and the soldering portion 213. The contacting portions 221 are received in the outer passageways 151 of the second terminal receiving passageways 15. The distance between the contacting portions 221 of the second conductive terminals 22 and the base portion 11 is bigger than that between the contacting portions 211 of the first conductive terminals 21 and the base portion 11. The first and second conductive terminal receiving passageways 14 and 15 are departed from each other and in two rows in a height direction of the insulative housing 10. From aspect of the role that the five second terminals 22 play, the five second terminals 21 include two differential signal pairs 226 and grounding terminal 225. The grounding terminal 225 is located between the two differential signal pairs 226. In application, the five conductive terminals 21 are used to transfer high speed D+, D− and ground signals, respectively.

Referring to FIG. 4, the connecting portion 222 of the grounding terminal 225 is in a reversed Y-shape in the front-to-rear direction that the grounding terminal 225 has two soldering portions 223. The soldering portions 223 extending from the same connecting portion 222 of grounding terminal of the second conductive terminals 22 are depart from each other and the differential signal pairs 215 of the first conductive terminals is located therebetween. With respect to the soldering portion 213/223 of the electrical connector 100, the soldering portions 213/223 are arranged in a line, and between the soldering portions 213/223 of two adjacent soldering portions 213/223, a differential signal pairs 215/226 is located. In this embodiment, the geometric profile of the electrical connector 100 meets to what of the standard USB 3.0 specification. The first conductive terminals are USB 2.0 terminals and the second conductive terminals are the USB 3.0 terminals. At the end the soldering portions 213/223 of the electrical connector 100, the nine terminals 20 is arranged in a line and have ten soldering portions in a line too. The role of the conductive terminals corresponding the ten soldering portions is described in turn is that the power terminals 214, the differential signal pairs (D+, D−) 226, the grounding terminal 225, the differential signal pairs (D+, D−) 215, the grounding terminal 225, the differential signal pairs (D+, D−) 226 and the grounding terminal 214, in turn. As a result that the soldering portions 213/223 of each two adjacent soldering portions 213/223, a differential signal pairs 215/226 is located, the cross-talk between two adjacent differentials pairs 215/226 are suppressed effectively.

Figure 6:
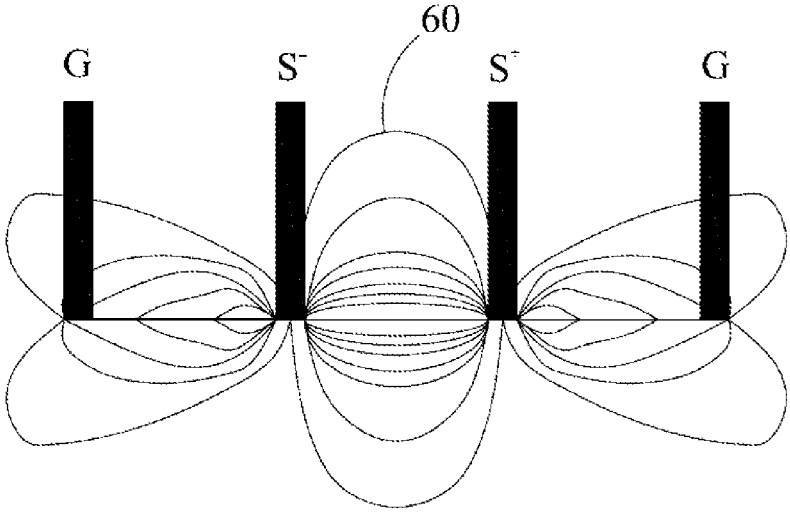
FIG. 6 is a schematic diagram of the electric field lines of the solder portions of the conductive terminals of the electrical connectors shown in FIG. 1.

To depict how the cross-talk between the adjacent differential pairs are suppressed, a schematic diagram of the electric field lines of the solder portions 213/223 of the conductive terminals 20 is shown in FIG. 6. As the soldering portions of 213/223 of the grounding terminals 214/225 are connecting with ground or grounding circuit, the electric potential of the soldering portions 213/223 is equal to each other, resulting in that a shielding space is formed between the adjacent differentials signal pair terminals to escape from EMI (Electromagnetic Interference) from external and the cross-talk between the adjacent differentials signal pair terminals are suppressed effectively. Thus, a better signal transmission property can be acquired for the electrical connector 100 according to the present invention.

The holding portions 30 (shown in FIG. 4) are provided to hold the second conductive terminal 22 at their proper positions. The holding portion 30 is insert-molded over the second conductive terminal 22 and is received in the receiving space 13 of the base portion 11. Turning to FIGS. 1, 4 and 5, the fixing element 40 is provided to fix the soldering portions 213/223 at their proper positions. The fixing element 40 includes a body portion 41 with a top side 411, a bottom side 413, a rear side 414 and a pair of left and right side 412. A pair of cantilever 42 protrudes upwardly form the top side 411 to mate with the locking portion 132 of the insulative housing 10. From the left and right side 412, a pair of engagement arms protrudes outwardly to engage with the a pair of first retaining portion 133. Thus, the fixing element 40 is fixed to the insulative housing 10 firmly. The body portion 41 of the fixing element 40 includes a plurality of recess 44 defined into the rear side 414 to position the soldering portions 213/223 of the conductive terminals 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mating with a mating connector for transmitting signals, comprising:

an insulative housing, the insulative housing comprising a base portion and a tongue portion extending forwardly from the base portion; and a plurality of conductive terminals held in the tongue portion, the conductive terminals comprising a contacting portion exposed to air and electrically contacting with the mating connector, a soldering portion extending out of the insulative housing and a connecting portion connecting the contacting portion and the soldering portion;

wherein the plurality of conductive terminals comprising a plurality of grounding terminals and a plurality of differential signal pairs; and wherein the soldering portions of each of differential signal pairs is located between two adjacent soldering portions of the grounding terminals;

wherein the differential signal pairs of the first conductive terminals is located between the two soldering portions of the grounding terminal of the second conductive terminals;

wherein the connecting portion of the grounding terminal of the second conductive terminals is configured in a reversed Y-shape;

wherein the electrical connector is a USB (Universal Serial Bus) 3.0 connector.

2. The electrical connector as claimed in claim 1, wherein the soldering portions of the conductive terminals are staggeredly arranged with each other.

3. The electrical connector as claimed in claim 2, wherein the two outmost soldering portions in the line is soldering portions of the grounding terminals.

4. The electrical connector as claimed in claim 1, further comprising a holding portion to hold the conductive terminals.

5. The electrical connector as claimed in claim 4, further comprising a fixing element 40 to locate the conductive terminals at their proper positions.

6. The electrical connector as claimed in claim 5, wherein the soldering portion of the conductive terminal is molded with the holding portion.

7. The electrical connector as claimed in claim 1, wherein the plurality of conductive terminal comprises a plurality of first conductive terminals and a plurality of second conductive terminals, the contacting portions of the first and second conductive terminals are arranged at a same side of the tongue portion.

8. The electrical connector as claimed in claim 7, wherein the grounding terminal of the second conductive terminals comprises two soldering portions extending from the same connecting portion, and wherein the two soldering portions depart from each other.

9. The electrical connector as claimed in claim 7, wherein the contacting portions of the first conductive terminals protrude beyond a bottom surface of the tongue portion with elasticity, and wherein the contacting portion of the second conductive terminals is flat and positioned away from the base portion further than the contacting portions of the first conductive terminals.

10. The electrical connector as claimed in claim 7, wherein the insulative housing comprises a plurality of first and second conductive terminal receiving passageways to receive the first and second conductive terminals respectively.

11. The electrical connector as claimed in claim 10, wherein the first and second conductive terminal receiving passageways are departed from each other and arranged in two rows along a height direction of the insulative housing.

12. The electrical connector as claimed in claim 10, wherein the tongue portion defines plurality through holes depressed inwardly form a bottom surface thereof in the height direction, and a plurality of slots depressed inwardly form a top surface thereof lengthwise, the through holes and the slots both communicating with second terminal passageways.

* * * * *